US005800960A

United States Patent [19]

Boroson et al.

[11] Patent Number: 5,800,960

[45] Date of Patent: Sep. 1, 1998

[54] UNIFORM BACKGROUND FOR COLOR TRANSFER

[75] Inventors: Michael L. Boroson; Judith L. Fleissig, both of Rochester; Edward A. Tickner, Pittsford, all of N.Y.

[73] Assignee: Eastman Kodak Company, Rochester, N.Y.

[21] Appl. No.: 738,951

[22] Filed: Oct. 24, 1996

[51] Int. Cl.[6] ..... G03C 8/00

[52] U.S. Cl. ..... 430/200; 430/7; 430/201; 430/945; 503/227

[58] Field of Search ..... 430/200, 201, 430/7, 945; 503/227

[56] References Cited

U.S. PATENT DOCUMENTS

| | | | |
|---|---|---|---|
| 4,541,830 | 9/1985 | Hotta et al. | 8/471 |
| 4,621,271 | 11/1986 | Brownstein | 346/76 |
| 4,695,287 | 9/1987 | Evans et al. | 8/471 |
| 4,695,288 | 9/1987 | Ducharme | 8/471 |
| 4,698,651 | 10/1987 | Moore et al. | 503/227 |
| 4,700,207 | 10/1987 | Vanier et al. | 503/227 |
| 4,701,439 | 10/1987 | Weaver et al. | 503/227 |
| 4,737,486 | 4/1988 | Henzel | 503/227 |
| 4,743,463 | 5/1988 | Ronn et al. | 427/53.1 |
| 4,743,582 | 5/1988 | Evans et al. | 503/227 |
| 4,753,922 | 6/1988 | Byers et al. | 503/227 |
| 4,757,046 | 7/1988 | Byers et al. | 503/227 |
| 4,769,360 | 9/1988 | Evans et al. | 503/227 |
| 4,772,582 | 9/1988 | DeBoer | 503/227 |
| 4,876,235 | 10/1989 | DeBoer | 503/227 |
| 4,912,083 | 3/1990 | Chapman et al. | 503/227 |
| 4,923,860 | 5/1990 | Simons | 503/227 |
| 4,942,141 | 7/1990 | DeBoer et al. | 503/227 |
| 4,948,776 | 8/1990 | Evans et al. | 503/227 |
| 4,948,777 | 8/1990 | Evans et al. | 503/227 |
| 4,948,778 | 8/1990 | DeBoer | 503/227 |
| 4,950,639 | 8/1990 | DeBoer et al. | 503/227 |
| 4,950,640 | 8/1990 | Evans et al. | 503/227 |
| 4,952,552 | 8/1990 | Chapman et al. | 503/227 |
| 4,973,572 | 11/1990 | DeBoer | 503/227 |
| 5,036,040 | 7/1991 | Chapman et al. | 503/227 |
| 5,126,760 | 6/1992 | DeBoer | 346/108 |
| 5,168,288 | 12/1992 | Baek et al. | 346/76 |
| 5,229,232 | 7/1993 | Longobardi et al. | 430/7 |
| 5,244,770 | 9/1993 | DeBoer et al. | 430/200 |
| 5,278,576 | 1/1994 | Kaszczuk et al. | 346/1.1 |

FOREIGN PATENT DOCUMENTS

| | | |
|---|---|---|
| 2083726 | 3/1982 | United Kingdom . |

*Primary Examiner*—John A. McPherson
*Attorney, Agent, or Firm*—Raymond L. Owens

[57] ABSTRACT

A method of producing a radiation-induced colorant transfer image on a support, includes the steps of: providing an image-receiving element comprising a support having thereon an image-receiving layer; providing a colorant donor element having a colorant transfer layer on a colorant element support and wherein colorant can be transferred from a transfer surface of the colorant donor element to the image-receiving element in response to selectively applied radiation; providing a uniformly reflecting opaque element that is sufficiently opaque to radiation at the wavelengths of the radiation source; causing the image-receiving element to be contacted with the colorant donor element and these elements to be positioned between the radiation source and the uniformly reflecting opaque element; and applying radiation to the colorant donor element to cause colorant to transfer to the image-receiving element.

6 Claims, 4 Drawing Sheets

UNIFORM BACKGROUND FOR COLOR TRANSFER

FIELD OF THE INVENTION

This invention relates to the use of uniform backgrounds to improve the density uniformity in a radiation-induced colorant transfer system.

BACKGROUND OF THE INVENTION

In recent years, radiation transfer systems have been developed to obtain prints from pictures which have been generated electronically from a color video camera; to obtain a color proof image before a printing press run is made; to form patterns on substrates for electronic, optical, and magnetic devices; and to form color filter arrays.

According to one way of obtaining prints, an electronic picture is first subjected to color separation by color filters. The respective color-separated images are then converted into electrical signals. These signals are then operated on to produce cyan, magenta and yellow electrical signals. These signals are then transmitted to a thermal printer. To obtain the print, a cyan, magenta or yellow dye-donor element is placed face-to-face with a dye-receiving element. The two are then inserted between a thermal printing head and a platen roller. A line-type thermal printing head is used to apply heat from the back of the dye-donor sheet. The thermal printing head has many heating elements and is heated up sequentially in response to the cyan, magenta or yellow signal. The process is then repeated for the other two colors. A color hard copy is thus obtained which corresponds to the original picture viewed on a screen. Further details of this process and an apparatus for carrying it out are contained in U.S. Pat. No. 4,621,271, the disclosure of which is hereby incorporated by reference.

Another way to thermally obtain a print using the electronic signals described above is to use a laser instead of a thermal printing head. In such a system, the donor sheet includes a material which strongly absorbs at the wavelength of the laser. When the donor is irradiated, this absorbing material converts light energy to thermal energy and transfers the heat to the dye in the immediate vicinity, thereby heating the dye to its vaporization temperature for transfer to the receiver. The absorbing material may be present in a layer beneath the dye and/or it may be admixed with the dye. The laser beam is modulated by electronic signals which are representative of the shape and color of the original image, so that each dye is heated to cause volatilization only in those areas in which its presence is required on the receiver to reconstruct the color of the original object. Further details of this process are found in GB 2,083,726A, the disclosure of which is hereby incorporated by reference.

Similar methods have been disclosed for obtaining color proofs. In U.S. Pat. No. 5,126,760 of DeBoer, the disclosure of which is hereby incorporated by reference, a thermal dye transfer process is described for producing a direct digital, halftone color proof of an original image. The proof is used to represent a printed color image obtained from a printing press.

In U.S. Pat. No. 4,743,463 of Ronn, et. al., the disclosure of which is hereby incorporated by reference, a method of forming patterns on a substrate or support is described. The method consists of using a laser beam to vaporize a layer of a specified pattern-forming material and to the deposit the pattern-forming material onto a substrate by moving the substrate and the laser beam relative to each other according to a predetermined pattern. This method is useful in forming elements comprising a metal or dye pattern on a substrate or a support, such as integrated circuits or color filter arrays.

One method to reduce the cost of color filter array manufacture while still maintaining the required quality is by use of radiation colorant transfer method as discussed in commonly-assigned U.S. Pat. No. 4,923,860, the disclosure of which is hereby incorporated by reference. In the method described therein, the color filter array is formed by transferring colorant to a polymer image-receiving layer on a transparent support from a colorant donor element by use of a mask and a high intensity light source. In such a system, the colorant donor element includes a material which strongly absorbs at the wavelength of the light source. When the colorant donor element is selectively irradiated, this absorbing material converts light energy to thermal energy and transfers the heat to the colorant transfer layer in the immediate vicinity, thereby transferring colorant from the transfer surface of the colorant donor element to the polymer image-receiving layer on the transparent support. The absorbing material may be present in a layer beneath the colorant transfer layer and/or it may be admixed with the colorant transfer layer.

Spacer beads may be employed in a separate layer over the colorant layer of the colorant donor element in the above described radiation processes in order to maintain a finite separation distance between the colorant donor element and the polymer image-receiving layer during colorant transfer. That invention is more fully described in U.S. Pat. No. 4,772,582, the disclosure of which is hereby incorporated by reference. The spacer beads may be coated with a polymeric binder if desired. Alternatively, spacer beads may be employed in the polymer image-receiving layer as described in U.S. Pat. No. 4,876,235, the disclosure of which is hereby incorporated by reference.

While the use of radiation colorant transfer offers advantages in cost, process steps, and image sharpness over current imaging methods, the use of a laser or other high intensity radiation source to transfer colorant has been found to occasionally result in density image defects (i.e., images with defect areas having a lower or higher density than surrounding areas) due to irregularities in the surface upon which the colorant donor element or image-receiving element is placed. In U.S. Pat. No. 5,278,576, the disclosure of which is hereby incorporated by reference, Kaszczuk et al. used an intermediate dye-receiving element with an integral reflecting opaque layer that was separated from the dye-receiving layer after laser thermal transfer to prevent non-uniform reflections from the surface upon which the intermediate dye-receiving element was placed. The use of an integral reflecting opaque layer that is separated from the dye-receiving layer after laser thermal transfer requires additional process steps for producing the image-receiving element. In addition the use of an intermediate receiving element requires an additional image transfer step, such as lamination. For final images on transparent substrates, such as slides, transparencies, and color filters, the method of Kaszczuk et al requires both the additional process steps for producing the intermediate dye-receiving element with an integral reflecting opaque layer and the additional image transfer step.

It would be desirable to provide a method to improve the uniformity of the colorant which is transferred by radiation, thereby resulting in improved colorant uniformity for radiation-induced colorant transfer. Moreover, it would be desirable to improve the uniformity of the colorant without requiring additional process steps for producing the image-receiving element and without requiring the use of an intermediate image-receiving element and an image transfer step. In addition it would be desirable to provide a method to improve the uniformity of the colorant which is transferred by radiation to an image-receiving element which includes a transparent substrate.

SUMMARY OF THE INVENTION

It is the object of this invention to provide a method of producing radiation-induced colorant transfer images with high colorant uniformity.

This object is achieved in a method of producing a radiation-induced colorant transfer image on a support, comprising:

a) providing an image-receiving element comprising a support having thereon an image-receiving layer;

b) providing a colorant donor element having a colorant transfer layer on a colorant element support and wherein colorant can be transferred from a transfer surface of the colorant donor element to the image-receiving element in response to selectively applied radiation;

c) providing a uniformly reflecting opaque element that is sufficiently opaque to radiation at the wavelengths of the radiation source;

d) causing the image-receiving element to be contacted with the colorant donor element and these elements to be positioned between the radiation source and the uniformly reflecting opaque element; and e) applying radiation to the colorant donor element to cause colorant to transfer to the image-receiving element.

In accordance with the invention, it has been found preferable that the reflective uniformity of the uniformly reflecting opaque element as measured by % difference in total reflectivity be less than about 80% and that the opacity at the wavelengths of the radiation source of the uniformly reflecting opaque element be greater than about 0.1 absorbtion density such that uniformity of the reflected radiation is sufficient to prevent image density defects due to non-uniformly reflected radiation.

ADVANTAGES

Advantages of the present invention include providing an improved colorant uniformity without having density image defects (i.e., images with defect areas having a lower or higher density than surrounding areas). Moreover, the present invention eliminates the need for additional process steps for producing the image-receiving element and the requirement for an intermediate image-receiving element and an image transfer step. In addition the present invention provides a method to improve the uniformity of the colorant which is transferred by radiation to an image-receiving element which includes a transparent substrate

DETAILED DESCRIPTION OF THE INVENTION

Figure 1:
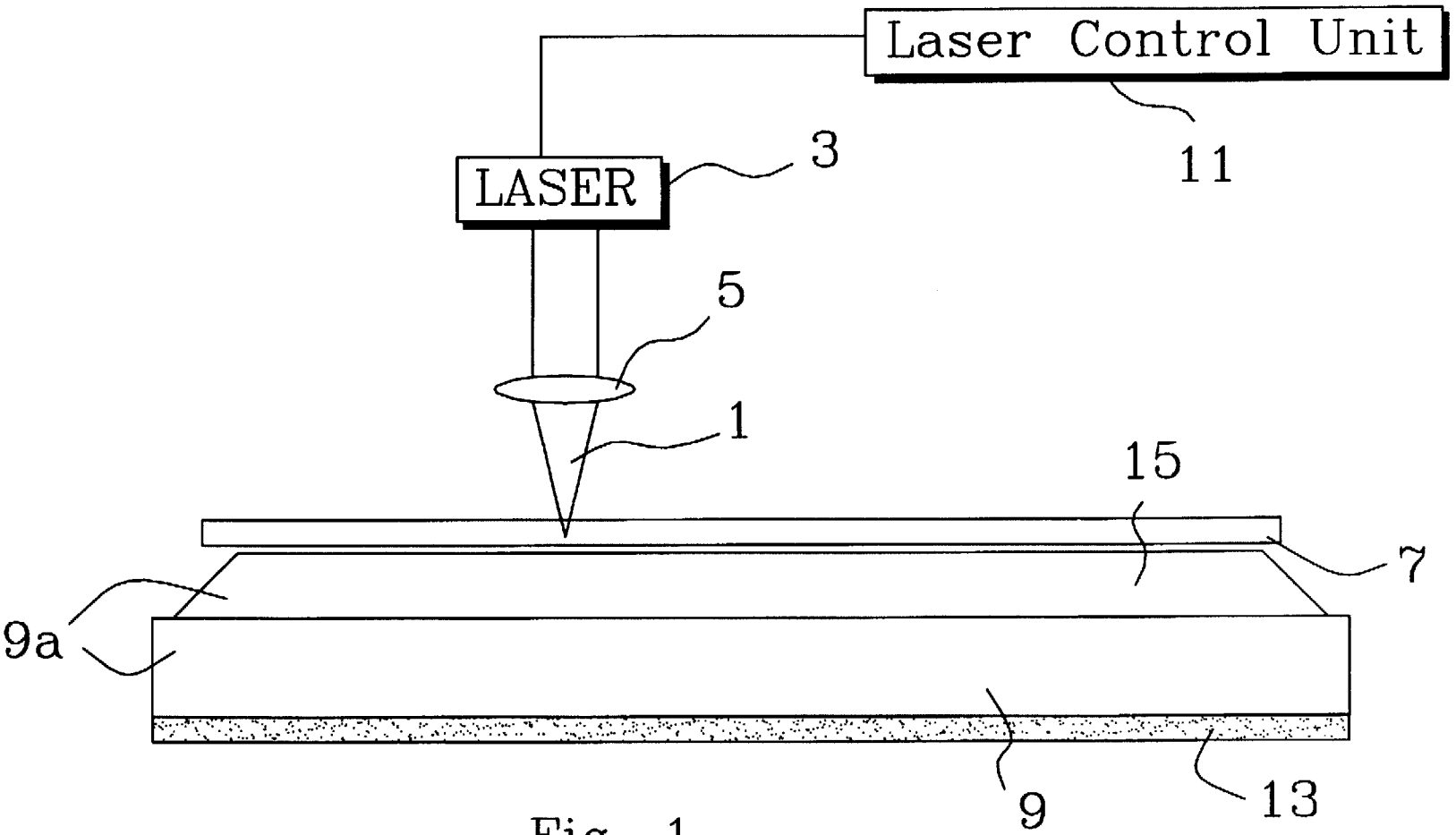
FIG. 1 shows in schematic form a step in the process of forming a radiation-induced colorant transfer image by using laser light and a uniformly reflecting opaque element to which the image-receiving element is adjacent.

Various methods can be used to transfer colorant from the colorant donor element to the image-receiving element to make the radiation-induced colorant transfer image of the invention. For example, a high intensity light flash from a xenon filled flash lamp can be used with a colorant donor element containing an energy absorptive material such as carbon black or a light-absorbing dye. This method is more fully described in commonly-assigned U.S. Pat. No. 4,923,860, the disclosure of which is incorporated herein by reference.

In another embodiment of the invention, the radiation is supplied by means of a laser, using a colorant donor element comprising a support having thereon a colorant transfer layer and an absorbing material for the wavelength of the laser.

To obtain the radiation-induced colorant transfer image employed in the invention, a diode laser is preferably employed since it offers substantial advantages in terms of its small size, low cost, stability, reliability, ruggedness, and ease of modulation. In practice, before any laser can be used to heat a colorant donor element, the element must contain an infrared-absorbing material, such as carbon black, cyanine infrared absorbing dyes as described in U.S. Pat. No. 4,973,572, or other materials as described in the following U.S. Pat. Nos. 4,948,777; 4,950,640; 4,950,639; 4,948,776; 4,948,778; 4,942,141; 4,952,552; 4,912,083; 4,942,141; 4,952,552; 5,036,040; and 4,912,083, the disclosures of which are hereby incorporated by reference. The laser radiation is then absorbed into the colorant layer and converted to heat by a molecular process known as internal conversion. Thus, the construction of a useful colorant layer will depend not only on the hue, transferability and intensity of the image colorants, but also on the ability of the colorant layer to absorb the radiation and convert it to heat. The infrared-absorbing material may be contained in the colorant layer itself or in a separate layer associated therewith.

Lasers which can be used to transfer colorant from colorant donor elements employed in the invention are available commercially. There can be employed, for example, Laser Model SDL-2420-H2 from Spectra Diode Labs, or Laser Model SLD 304 V/W from Sony Corp.

A thermal printer which uses the laser described above to form an image on a thermal print medium is described in commonly assigned U.S. Pat. No. 5,168,288 of Baek and DeBoer, the disclosure of which is hereby incorporated by reference.

Any colorant can be used in the colorant donor element employed in the invention provided it is transferable to the image-receiving element by the action of the radiation. The colorants used in the invention may include pigments or dyes. Especially good results have been obtained with sublimable dyes such as anthraquinone dyes, e.g., Sumikalon Violet RS® (product of Sumitomo Chemical Co., Ltd.), Dianix Fast Violet 3R-FS® (product of Mitsubishi Chemical Industries, Ltd.), and Kayalon Polyol Brilliant Blue N-BGM® and KST Black 146® (products of Nippon Kayaku Co., Ltd.); azo dyes such as Kayalon Polyol Brilliant Blue BM®, Kayalon Polyol Dark Blue 2BM®, and KST Black KR® (products of Nippon Kayaku Co., Ltd.), Sumickaron Diazo Black 5G® (product of Sumitomo Chemical Co., Ltd.), and Miktazol Black 5GH® (product of Mitsui Toatsu Chemicals, Inc.); direct dyes such as Direct Dark Green B® (product of Mitsubishi Chemical Industries, Ltd.) and Direct Brown M® and Direct Fast Black D® (products of Nippon Kayaku Co. Ltd.); acid dyes such as Kayanol Milling Cyanine 5R® (product of Nippon Kayaku Co. Ltd.); basic dyes such as Sumicacryl Blue 6G® (product of Sumitomo Chemical Co., Ltd.), and Aizen Malachite Green® (product of Hodogaya Chemical Co., Ltd.);

(magenta)

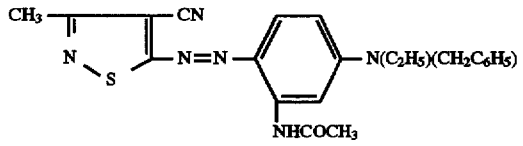

M-1

(magenta)

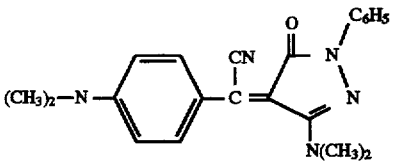

M-2

(yellow)

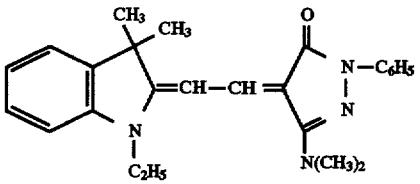

Y-1

(yellow)

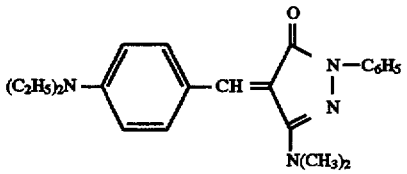

Y-2

(yellow)

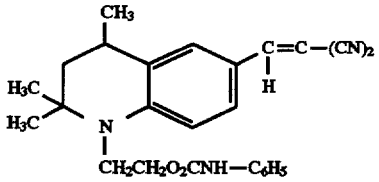

Y-3

(cyan)

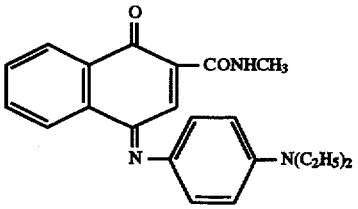

C-1

-continued (cyan)

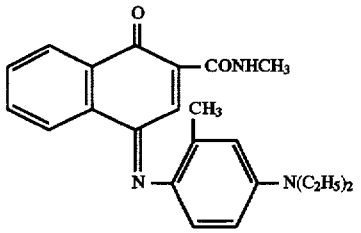

C-2 or any of the dyes disclosed in U.S. Pat. Nos. 4,541,830, 4,698,651, 4,695,287, 4,701,439, 4,757,046, 4,743,582, 4,769,360, and 4,753,922, the disclosures of which are hereby incorporated by reference. The above dyes may be employed singly or in combination. The dyes may be used at a coverage of from about 0.05 to about 1 g/m$^2$ and are preferably hydrophobic.

The colorant in the colorant donor element employed in the invention is dispersed in a polymeric binder such as a cellulose derivative, e.g., cellulose acetate hydrogen phthalate, cellulose acetate, cellulose acetate propionate, cellulose acetate butyrate, cellulose triacetate or any of the materials described in U.S. Pat. No. 4,700,207; a polycarbonate; polyvinyl acetate, poly(styrene-co-acrylonitrile), a poly(sulfone) or a poly(phenylene oxide). The binder may be used at a coverage of from about 0.1 to about 5 g/m$^2$.

The colorant transfer layer of the colorant donor element may be coated on the support or printed thereon by a printing technique such as a gravure process.

Any material can be used as the support for the colorant donor element employed in the invention provided it is dimensionally stable and can withstand the heat of the radiation. Such materials include polyesters such as poly (ethylene terephthalate); polyamides; polycarbonates; cellulose esters such as cellulose acetate; fluorine polymers such as polyvinylidene fluoride or poly(tetrafluoroethylene-co-hexafluoropropylene); polyethers such as polyoxymethylene; polyacetals; polyolefins such as polystyrene, polyethylene, polypropylene or methylpentane polymers; and polyimides such as polyimideamides and polyetherimides. The support may also be coated with a subbing layer, if desired, such as those materials described in U.S. Pat. Nos. 4,695,288 or 4,737,486.

The image-receiving element that is used with the colorant donor element employed in the invention generally comprises a support having thereon a polymer image-receiving layer. The support may be glass or a transparent film such as a poly(ether sulfone), a polyimide, a cellulose ester such as cellulose acetate, a poly(vinyl alcohol-co-acetal) or a poly(ethylene terephthalate). The support for the image-receiving element may also be reflective such as baryta-coated paper, white polyester (polyester with white pigment incorporated therein), an ivory paper, a condenser paper or a synthetic paper such as duPont Tyvek®. In a preferred embodiment, polyester with a white pigment incorporated therein is employed. In another preferred embodiment, the image-receiver support may also be colorant-receptive so that a separate image-receiving layer is not required.

The image-receiving layer may comprise a polymer compatible with the colorant such as, for example, a polycarbonate, a polyurethane, a polyester, polyvinyl chloride, poly(styrene-co-acrylonitrile), poly(caprolactone) or mixtures thereof. The image-receiving layer may be present in any amount which is effective for the intended purpose. In general, good results have been obtained at a concentration of from about 1 to about 5 g/m$^2$.

In one embodiment of the invention, the radiation is supplied by means of a laser, using a colorant donor element comprising a support having thereon a colorant transfer layer and an absorbing material for the wavelength of the laser. FIG. 1 shows the practice of such an apparatus. In this arrangement, the light emission 1 of a laser 3 is focused by lens or optical system 5 onto the colorant donor element 7. The colorant donor element 7 has a transfer surface wherein colorant, such as dye, is transferred in response to selectively applied radiation to an image-receiving element 9a which will be understood to include at least an image-receiving support 9 and an image-receiving layer, typically a polymer image-receiving layer 15. Typically, such layers include an adhesion layer or a cushion layer. The intensity and movement of the laser 3, the colorant donor element 7, then image-receiving element 9*a*, and a uniformly reflecting opaque element 13 are controlled by the laser control unit 11 in such a manner as to produce colorant in the appropriate location. Light emission 1 not absorbed in the colorant donor element 7 is reflected and absorbed by the uniformly reflecting opaque element 13. The reflected portion of the light emission 1 is absorbed in the colorant donor element 7, heats the donor imagewise, and causes additional colorant to transfer to the polymer image-receiving layer 15.

The uniformly reflecting opaque element 13 may be a separate element or an integral part of the image-receiving element 9*a*, which may or may not be removed from the image-receiving element after radiation-induced colorant transfer. Any material that uniformly absorbs and reflects the radiant energy described above can be used as the absorbing and reflecting surface of the uniformly reflecting opaque element, for example, aluminum, stainless steel, silver, chrome, anodized aluminum, carbon black or non-volatile infrared-absorbing dyes or pigments which are well known to those skilled in the art. It has been found advantageous for the reflective uniformity of the uniformly reflecting opaque element as measured by % difference in total reflectivity to be less than about 80% and for the opacity at the wavelengths of the radiation source of the uniformly reflecting opaque element to be greater than about 0.1 absorbtion density such that uniformity of the reflected radiation is sufficient to prevent image density defects due to non-uniformly reflected radiation. In a preferred embodiment, % difference in total reflectivity is less than about 50% and opacity is greater than about 0.5 absorbtion density.

Figure 2:
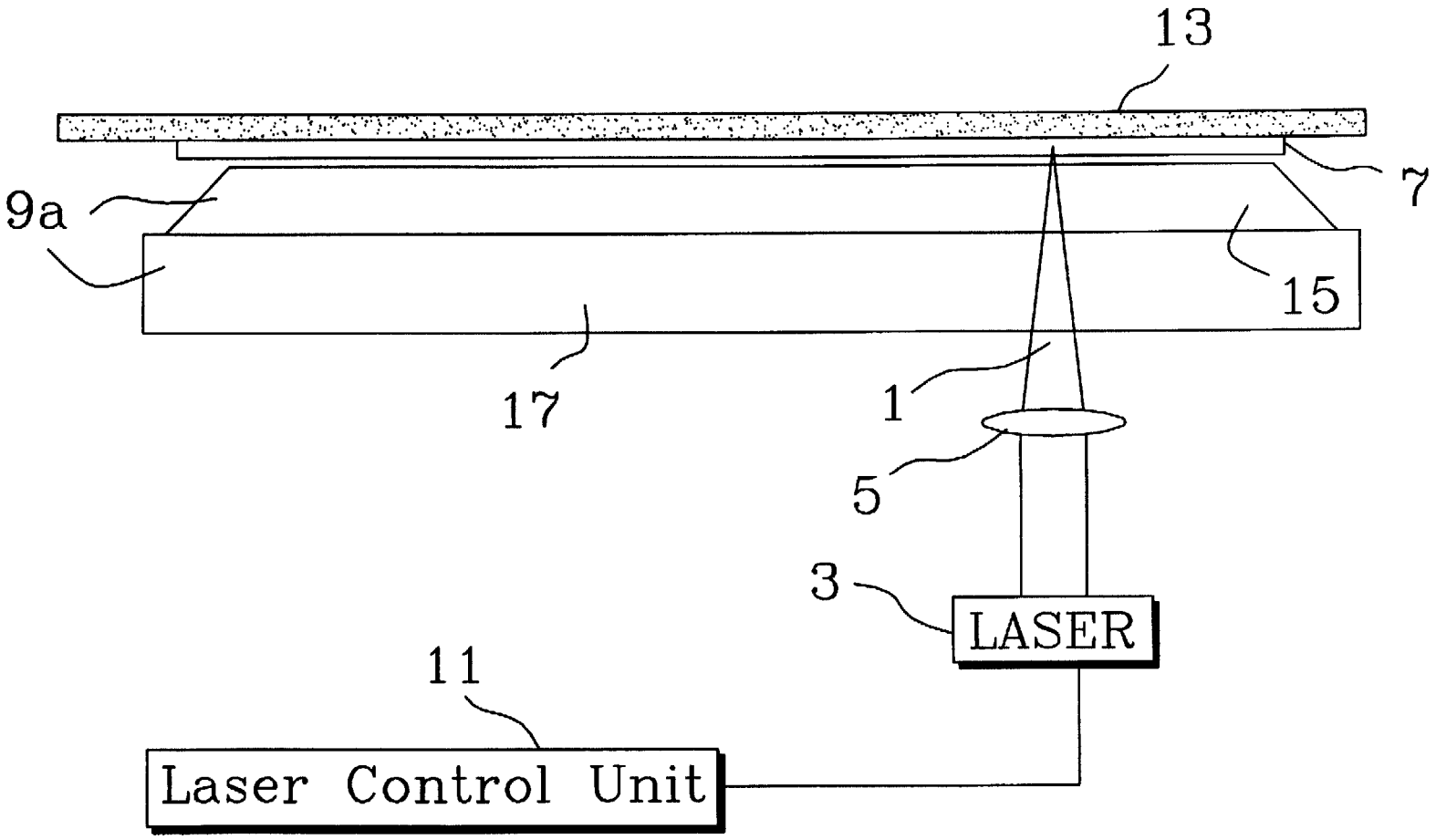
FIG. 2 shows in schematic form a step in the process of forming a radiation-induced colorant transfer image by using laser light and a uniformly reflecting opaque element to which the colorant donor element is adjacent.

In another embodiment of the invention shown in FIG. 2, the light emission 1 supplied by means of a laser 3 is directed through a transparent support 17 of the image-receiving element 9*a* onto the colorant donor element 7 and the colorant donor element 7 is adjacent to the uniformly reflecting opaque element 13. The intensity and movement of the laser 3, colorant donor element 7, image-receiving element 9*a*, and uniformly reflecting opaque element 13 are controlled by the laser control unit 11 in such a manner as to produce colorant in the appropriate location. Light emission 1 not absorbed in the colorant donor element 7 is reflected and absorbed by the uniformly reflecting opaque element 13. The reflected portion of the light emission 1 is absorbed in the colorant donor element 7, heats the donor imagewise, and causes additional colorant to transfer to the polymer image-receiving layer 15.

Figure 3:
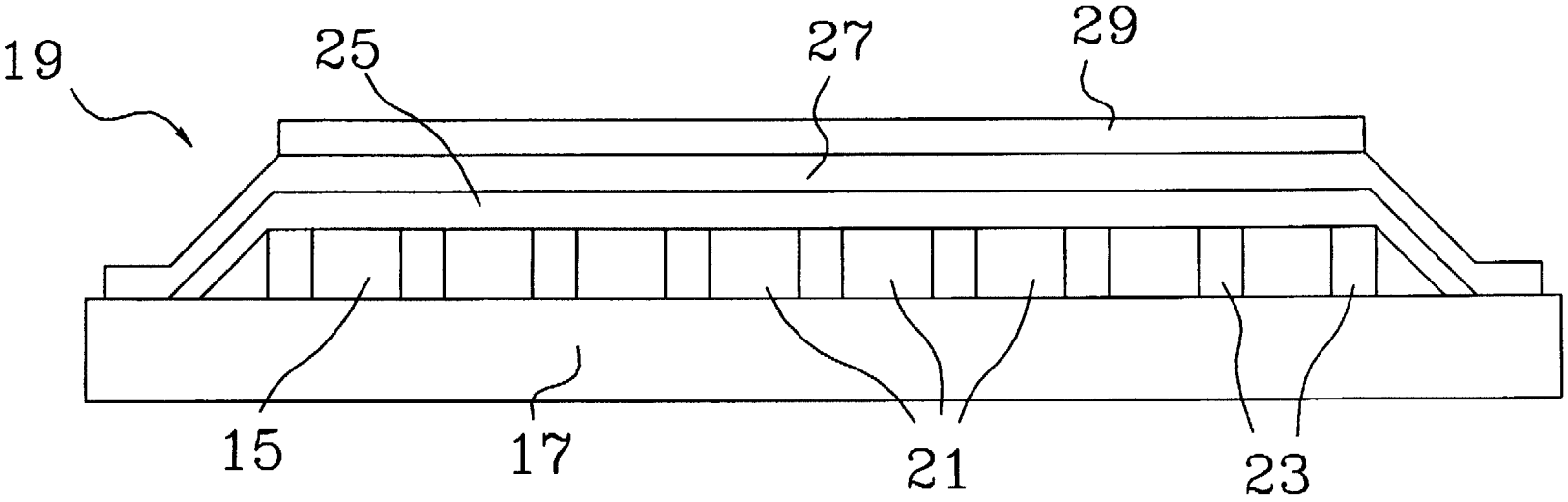
FIG. 3 is a cross-sectional view of a color filter array made in accordance with the present invention.

FIG. 3 shows a cross sectional schematic of a color filter array 19 made in accordance with the present invention which can be used in a liquid crystal display device (not shown). The color filter array 19 includes a transparent support 17 formed of glass, plastic, or other suitable material. The color filter array 19 includes red (R), green (G), and blue (B) color cells or pixels cells 21 embedded in a polymer-image receiving layer 15. It will be understood to those skilled in the art that other colors, such as cyan, magenta and yellow can also be used. Black grid lines 23 separate each color pixel. The color filter array 19 has a polymeric protective overcoat layer 25 and also can be coated with a transparent conducting layer 27 which is formed of a suitable material, for example, indium tin oxide (ITO). When used in a liquid crystal device (LCD) an alignment layer 29 is used.

Figure 4:
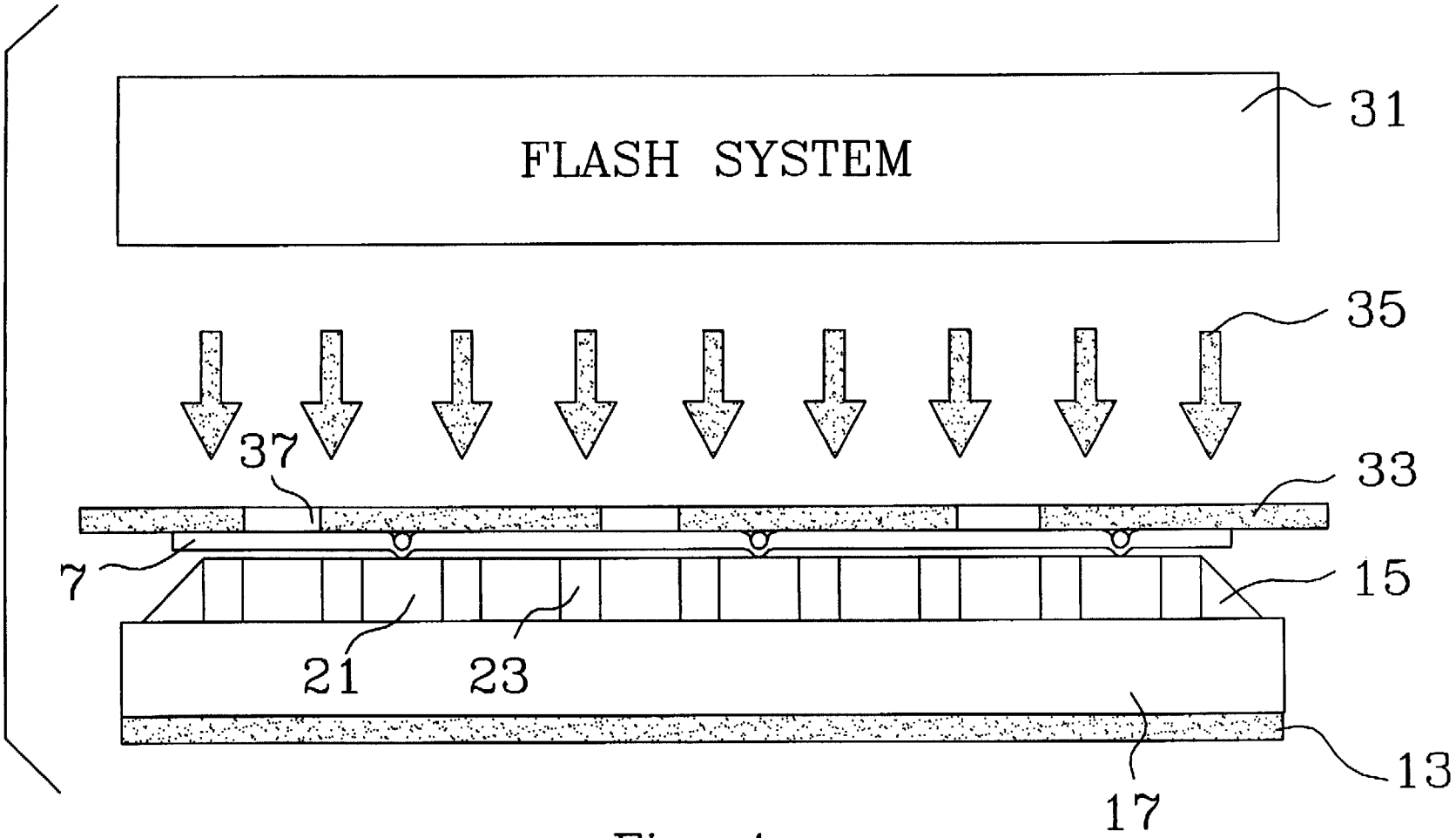
FIG. 4 shows a step in the process of making the color filter array of FIG. 3 wherein the image-receiving element is adjacent to a uniformly reflecting opaque element.

FIG. 4 shows schematically an apparatus for imagewise transfer of the colorants into the polymer image-receiving layer 15. A flash system 31 illuminates a mask 33, which imagewise discriminates the impinging radiation 35 onto the colorant donor element 7. The mask 33 can be, but is not limited to, chromium on glass such as is common in the art. The radiation 35 passes through the transparent regions 37, in the mask 33, illuminates the colorant donor element 7, is absorbed in the colorant transfer layer, heats the donor imagewise, and causes colorant to transfer to the polymer image-receiving layer 15. Radiation 35 not absorbed in the colorant donor element 7 is reflected and absorbed by the uniformly reflecting opaque element 13. The reflected portion of the radiation 35 is absorbed in the colorant donor element 7, heats the donor imagewise, and causes additional colorant to transfer to the polymer image-receiving layer 15. Preferably, the same mask 33 can be used in the sequential process of forming different colored pixels. If it is used then of course it would have to moved laterally to form the next set of thermal pixels of a different color. See commonly-assigned U.S. Pat. No. 5,229,232, the disclosure of which is incorporated herein by reference.

Any material that absorbs the laser energy or high intensity light flash described above can be used as the absorbing material in the colorant donor element, for example, carbon black or non-volatile infrared-absorbing dyes or pigments which are well known to those skilled in the art. In a preferred embodiment, cyanine infrared absorbing dyes are employed as described in commonly-assigned U.S. Pat. No. 4,973,572, the disclosure of which is hereby incorporated by reference.

Irrespective of whether laser or flash lamps are employed to transfer the dye from the donor to the polymeric image-receiving layer, the intensity of the radiation should be high enough and the duration of the flash should be short enough that there is no appreciable heating of the assembly with concomitant significant dimension change in the pattern of color cell or pixel cells 5. In this invention, the preferred duration of flash is from 1 microsecond to 30 milliseconds. The preferred intensity of the flash is from 0.01 Watts per square micrometer to 10 Watts per square micrometer.

The following examples are provided to illustrate the invention.

EXAMPLE 1

Image-receiving elements were prepared by coating onto a 0.11 cm glass support an anisole solution of 11 wt% of the Receiver polymer illustrated below resulting, after hot plate drying for 1 min at 60° C., in a 1.7 μm thick coating.

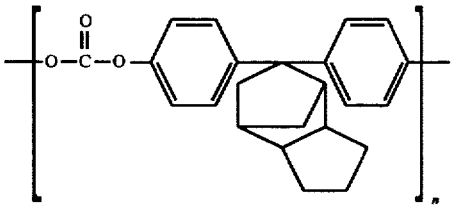

Receiver Polymer

Colorant donor elements were prepared by first coating onto 35 μm PET a layer comprising 0.26 g/m$^2$ magenta dye M-1 illustrated above, 0.29 g/m$^2$ yellow dye illustrated above, 0.02 g/m$^2$ carbon black, 0.30 g/m$^2$ Butvar 76 (a poly(vinyl butyral) available from Monsanto Co.), and 0.005 g/m$^2$ Fluorad FC-431 (a perfluorinated surfactant available from 3M Corp.).

A 12.7 cm square chrome on quartz mask was held by 5.0 kN/m$^2$ of vacuum in a fixture. The pattern on the mask consisted of one rectangular patch 1.2 cm wide and 4.2 cm long. A colorant donor element was placed on the mask with the back of the colorant donor element in contact with the mask. The colorant donor element was pressed against the mask by evacuating a vacuum channel surrounding the mask to 5.0 kN/m$^2$ of vacuum. A 25 μm spacer was placed on the colorant donor element outside of the rectangular patch pattern on the mask. An image-receiving element was placed on the spacer with the polymer image-receiving layer in contact with the spacer. Combinations of two opaque elements as shown in Table 1 were placed on the back of the polymer image-receiving element. The colorant donor element was exposed through the mask to a flash from a 900 volt flash lamp (EG&G, Salem, MA, Model FXQ-254-6 lamp) to patternwise transfer the colorant from the colorant donor element to the image-receiving element. The imaged colorant donor element and image-receiving element were then separated and the transferred image was fused into the polymer image-receiving layer by exposing the polymer image-receiving layer to dichloromethane vapor at 21° C. for 5 sec. Yellow density of the image corresponding to each opaque element was measured on an X-rite 310 Color Transmission/Reflection Densitometer (X-rite Co., Grandville, MI). The following results were obtained:

The above results show that improved uniformity is obtained by using a uniformly reflecting opaque element. Although the absolute image density obtained depends on the reflectivity of the opaque element, image density uniformity is dependent only on the reflectivity uniformity of the opaque element as measured by the % difference in total reflectivity and is independent of the specific reflectivity of the opaque element. As shown in the results a % difference in total reflectivity less than 90% is necessary to improve uniformity.

EXAMPLE 2

Image-receiving elements and colorant donor elements were prepared as in Example 1.

A 12.7 cm square chrome on quartz mask was held by 5.0 kN/m$^2$ Of vacuum in a fixture. The pattern on the mask consisted of one rectangular patch 1.2 cm wide and 4.2 cm long. A colorant donor element was placed on the mask with the back of the colorant donor element in contact with the mask. The colorant donor element was pressed against the mask by evacuating a vacuum channel surrounding the mask to 5.0 kN/m$^2$ of vacuum. A 25 μm spacer was placed on the colorant donor element outside of the rectangular patch pattern on the mask. An image-receiving element was placed on the spacer with the polymer image-receiving layer in contact with the spacer. Uniformly opaque elements consisting of neutral density filters as shown in Table 2 were placed on the back of the image-receiving element. A highly non-uniform element (Silverlux and black paper) was placed on the back of the uniformly opaque element. The colorant donor element was exposed through the mask to a flash from a 900 volt flash lamp (EG&G, Salem, MA, Model FXQ-254-6 lamp) to patternwise transfer the colorant from the colorant donor element to the image-receiving element. The imaged colorant donor element and image-receiving element were then separated and the transferred image was fused into the polymer image-receiving layer by exposing the polymer image-receiving layer to dichloromethane vapor at 21° C. for 5 sec. Yellow density of the image corresponding to each opaque element was measured on an X-rite 310 Color Transmission/Reflection Densitometer (X-rite Co., Grandville, Mich.) to determine the reflectivity uniformity and opacity required to decrease density defects due to non-uniformity behind the opaque element. The following results were obtained:

TABLE 1

| Opaque Element 1 | Opaque Element 2 | % Total Reflectivity Element 1 | % Total Reflectivity Element 2 | % Δ Total Reflectivity | Density Area 1 | Density Area 2 | Density Difference |
|---|---|---|---|---|---|---|---|
| Silverlux* | Silverlux | 100 | 100 | 0 | 2.86 | 2.90 | −0.04 |
| Black Paper | Black Paper | 5.1 | 5.1 | 0 | 2.16 | 2.18 | −0.02 |
| White Paper | White Paper | 69.1 | 69.1 | 0 | 2.76 | 2.75 | 0.01 |
| Silverlux | Black Paper | 100 | 5.1 | 94.9 | 2.86 | 2.18 | 0.68 |
| Silverlux | White Paper | 100 | 69.1 | 30.9 | 2.86 | 2.75 | 0.11 |
| White Paper | Black Paper | 69.1 | 5.1 | 92.6 | 2.76 | 2.18 | 0.58 |

*Available from 3M Corp.

TABLE 2

| Density of Opaque Element | % Total Reflectivity Element 1* | % Total Reflectivity Element 2** | % Δ Total Reflectivity | Colorant Density Area 1 | Colorant Density Area 2 | Density Difference |
|---|---|---|---|---|---|---|
| none | 100 | 5.1 | 94.9 | 2.86 | 2.18 | 0.68 |
| 0.2 | 37.2 | 8.6 | 76.9 | 2.34 | 2.10 | 0.24 |
| 0.3 | 30.5 | 7.7 | 74.8 | 2.32 | 1.93 | 0.39 |
| 0.5 | 12.3 | 6.3 | 48.8 | 2.21 | 2.06 | 0.15 |
| 1.0 | 6.4 | 6.1 | 4.7 | 2.12 | 2.11 | 0.01 |

*Element 1 comprises Silverlux plus the corresponding opaque element
**Element 2 comprises black paper plus the corresponding opaque element The above results show that improved uniformity is obtained by using a more uniformly reflecting opaque element as measured by the % difference in total reflectivity. As shown in the results a % difference in total reflectivity less than about 80% is preferred to improve uniformity and a % difference in total reflectivity less than about 50% is most preferred to improve uniformity. Improved uniformity is also obtained using a more opaque element to reduce the effect of nonuniformities behind the opaque element with a density of at least about 0.1 preferred and at least about 0.5 most preferred.

The invention has been described in detail with particular reference to certain preferred embodiments thereof, but it will be understood that variations and modifications can be effected within the spirit and scope of the invention.

PARTS LIST

1 light emission
3 laser
5 lens or optical system
7 colorant donor element
9 image-receiving support
9a image-receiving element
11 laser control unit
13 uniformly reflecting opaque element
15 polymer image-receiving layer
17 transparent support
19 color filter array
21 color cells or pixel cells
23 black grid lines
25 polymeric protective overcoat layer
27 transparent conducting layer
29 alignment layer
31 flash system
33 mask
35 radiation
37 transparent regions

We claim:

1. A method of producing a radiation-induced colorant transfer image on a support, comprising:

a) providing an image-receiving element comprising a support having thereon an image-receiving layer;

b) providing a colorant donor element having a colorant transfer layer on a colorant element support and wherein colorant can be transferred from a transfer surface of the colorant donor element to the image-receiving element in response to selectively applied radiation;

c) providing a uniformly reflecting opaque element that is sufficiently opaque to radiation at the wavelengths of the radiation source and reflects uniformly with a % difference in total reflectivity less than 80% but greater than 4.1%, and wherein the opacity is greater than 0.1 absorption density;

d) causing the image-receiviug element to be contacted with the colorant donor element and these elements to be positioned between the radiation source and the uniformly reflecting opaque element; and e) applying radiation to the colorant donor element to cause colorant to transfer to the image-receiving element.

2. The method of claim 1 wherein the uniformly reflecting opaque element is fixed to the colorant donor element.

3. The method of claim 1 wherein the uniformly reflecting opaque element is fixed to the image-receiving element.

4. A method of producing a radiation-induced colorant transfer image on a support, comprising:

a) providing an image-receiving element comprising a support having thereon an image-receiving layer;

b) providing a colorant donor element having a colorant transfer layer on a colorant element support and wherein colorant can be transferred from a transfer surface of the colorant donor element to the image-receiving element in response to selectively applied radiation;

c) providing a uniformly reflecting opaque element that is sufficiently opaque to radiation at the wavelengths of the radiation source and reflects uniformly with a % difference in total reflectivity less than 50% but greater than 4.7%, and wherein the opacity is greater than 0.5 absorption density;

d) causing the image-receiving element to be contacted with the colorant donor element and these elements to be positioned between the radiation source and the uniformly reflecting opaque element; and e) applying radiation to the colorant donor element to cause the colorant to transfer to the image-receiving element.

5. The method of claim 4 wherein the uniformly reflecting opaque element is fixed to the colorant donor element.

6. The method of claim 4 wherein the uniformly reflecting opaque element is fixed to the image-receiving element.

* * * * *

UNITED STATES PATENT AND TRADEMARK OFFICE

CERTIFICATE OF CORRECTION

PATENT NO. : 5,800,960
DATED : September 1, 1998
INVENTOR(S) : Michael L. Boroson, et al It is certified that error appears in the above-identified patent and that said Letters Patent is hereby corrected as shown below:

Column 12, line 20 "4.1%" should be corrected to read --4.7%--.

Signed and Sealed this

Twenty-second Day of December, 1998

*Attest:*

BRUCE LEHMAN

*Attesting Officer*

*Commissioner of Patents and Trademarks*